United States Patent [19]

Krause et al.

[11] 4,281,934

[45] Aug. 4, 1981

[54] APPARATUS FOR MIXING CONSTRUCTION MATERIALS

[76] Inventors: Ulrich Krause, Prinz Christianweg 13; Peter Krause, Park Rosenhoehe 4, both of 6100 Darmstadt, Fed. Rep. of Germany

[21] Appl. No.: 70,875

[22] Filed: Aug. 29, 1979

[30] Foreign Application Priority Data

Sep. 12, 1978 [AT] Austria ..... 6571/78

[51] Int. Cl.[3] ..... B28C 5/14; B28C 7/06; B01F 7/04; B01F 15/02

[52] U.S. Cl. ..... 366/30; 366/66; 366/150; 366/300; 366/301; 366/326

[58] Field of Search ..... 366/6, 30, 33, 35, 37, 366/38, 50, 64, 66, 67, 150, 297, 300, 301, 326, 603, 606

[56] References Cited

U.S. PATENT DOCUMENTS

| | | | |
|---|---|---|---|
| 1,355,137 | 10/1920 | Frick | 366/326 |
| 1,419,397 | 6/1922 | Marsh | 366/300 |
| 1,964,523 | 6/1934 | McConnaughay | 366/30 |

*Primary Examiner*—Philip R. Coe
*Attorney, Agent, or Firm*—W. G. Fasse; D. F. Gould

[57] ABSTRACT

The present mixer for construction materials, such as a bituminous sludge, has a trough with an inlet and an outlet and two mixing shafts equipped with blades rotatably supported in the trough in parallel to each other. The blades are uniformly spaced along both shafts and staggered by 90° around each shaft whereby the blades of each shaft follow one another in helical succession. Simultaneously the blades form four in line rows on each shaft. The arrangement of the blades is identical on each shaft except that the helix formed by the blades on one shaft has preferably a pitch direction opposite to that formed by the blades on the other shaft since the shafts rotate in opposite directions but convey in the same direction. The spacing between adjacent blades on both shafts is the same. However, blades located in the same plane extending perpendicularly to the longitudinal axes of the shafts are always spaced by 90° and blades which face each other extend in parallel to each other when pointing in the opposite directions toward the respective other shaft.

7 Claims, 5 Drawing Figures

FIG. 3
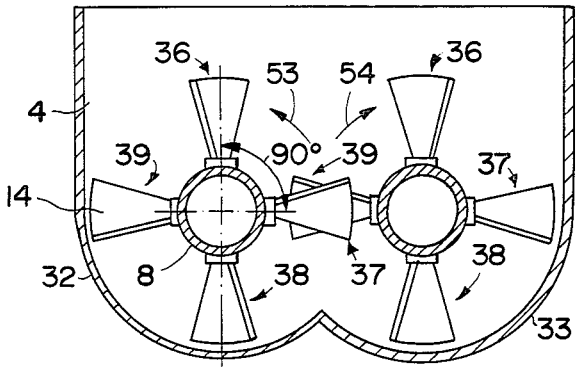
FIG. 5
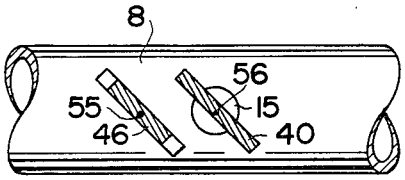
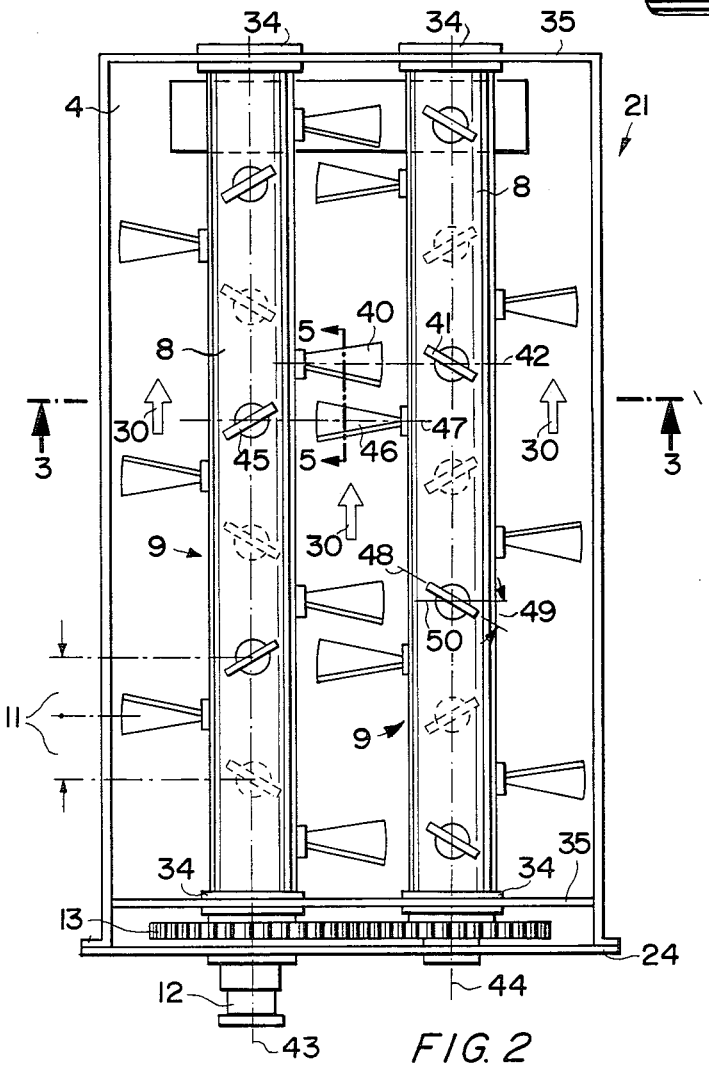
FIG. 2
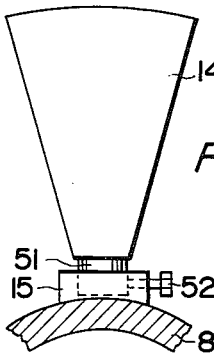
FIG. 4

APPARATUS FOR MIXING CONSTRUCTION MATERIALS

BACKGROUND OF THE INVENTION

The present invention relates to an apparatus for mixing construction materials. More specificially, the present apparatus is constructed for preparing bituminous sludges or paste type mixtures such as bituminuous mixtures for installation in or on a surface such as a road surface, driveway surface or the like.

Mixers of this type are known in the art and comprise a mobile multiple chamber container which may be a vehicle for storing of mineral aggregate and the bituminuous binder agent. The container vehicle may be equipped with means for discharging predetermined, proportional quantities of the aggregate and binder agent into the mixer proper. The mixer may be connected to or may be arranged for cooperation with the vehicle. Such mixers are commonly intended for a continuous mixing operation and for continuously discharging of the mixed material onto the surface during travel or feed advance of the apparatus over the surface to be treated.

The mixer proper comprises two mixing tools each including a mixing shaft. The feed advance direction extends in a direction opposite to the direction of travel. The two mixing shafts rotate in opposite directions and are equipped with mixing blades which lift the material out of the center of the mixer to slope the material upwardly. The mixing tools, as they continue to rotate, transport the material in the direction toward the discharge opening or end of the mixer. Such discharge opening or end is located in the zone of the rear facing wall of the mixer.

In an apparatus of this type the circumferential speed of the mixing shafts, or rather of the mixing blades secured to these shafts, may be adjusted to a speed exceeding five meters per second (5 m/sec). The two mixing shafts have a given spacing from each other center to center. The enveloping circles defined by the rotating mixing blades secured to the mixing shafts have a diameter corresponding to about 1.5 times said given spacing between the mixing shafts. The radii of the trough sections correspond to about 0.75 times said given spacing. The width perpendicular to both said longitudinal axes corresponds to about 2.5 times said given spacing between the mixing shafts. The length of the mixing trough corresponds to about 2.4 times to 3.0 times the just mentioned width of the trough.

The relatively rapid drive of the mixer resulting in the above circumferential speed and the just mentioned dimensions of the mixer have been found to be basically useful. However, the required number of mixing blades is substantial because the mixing blades are spaced by 45° from each other, whereby the blades are arranged in groups of four in such a manner that blades of one group reach into the zone of the blades of the next adjacent group of four blades. The blades, in addition to being arranged in groups of four, have trapezoidal shapes which widen radially outwardly. The blades are also adjustable in their angle of attack relative to the mixing shafts. The blades of one group are spaced from each other by 90°. However, since the blades of one group reach into the zone of another group, the spacing between adjacent blades is 45° as mentioned. Thus, a mixer of the just described type comprises at least nine groups of four blades each on each shaft which amounts to a total of 72 blades.

The above described features have the disadvantage that due to the large number of blades the weight of the mixer is correspondingly large. Further, the power required for driving such a mixer is also substantial due to said large number of blades and the resulting weight. Another drawback is seen in that the mixing space needs to be voluminous yet provides a poor accessibility when cleaning or repairs become necessary. In spite of the large number of blades the mixing intensity leaves room for improvement. This appears to be due to the fact that in spite of the large number of blades there remain large free spaces between the blades reaching into each other so to speak and these large free spaces in turn prevent the imparting of shearing forces to the materials to be mixed in the central zone of the mixer. Basically, in the just described apparatus merely two oppositely rotating mixing rollers are formed which are guided or rather arranged in parallel to each other and the interaction of which is rather limited in the central zone of the trough due to the highly liquid type characteristics of the material.

OBJECTS OF THE INVENTION

In view of the above it is the aim of the invention to achieve the following objects singly or in combination:

to construct a mixer of the type described which will have an increased mixing intensity and mixing efficiency while simultaneously operating with a substantially reduced number of mixing blades;

to construct the blades so that they are easily attached and removed, for example, to be exchanged or for maintenance or cleaning purposes;

to arrange the blades in such a manner that pairs of blades, one on each shaft, extend temporarily in parallel to each other when the shafts rotate in opposite directions and the axes of the respective blades extend horizontally and in opposite directions;

to arrange the blades in such a manner that substantial shearing forces will be imparted to the materials being mixed, especially in the centrally located zone of the mixer where the materials are being piled up temporarily;

to substantially reduce the structural weight of such mixers;

to make the blades position adjustable so that their angle of attack may be different on both mixing shafts; or even on the same shaft; and to construct the mixer as a trailer type trough, the axial position of which is adjustable.

SUMMARY OF THE INVENTION

According to the invention an apparatus of the type described above is characterized in that the mixing tools are substantially mixing blades which are arranged at uniform spacings at the respective shaft diameter. The blades are arranged individually and progressively along the working length of the shafts with a 90° staggering relative to the preceding mixing blade. The uniformly spaced arrangement of the mixing blades around both shafts is uni-directionally constructed independently of the drive of the shafts in opposite directions. Between the position of mixing blades correlated to each other on the shaft rotating in clockwise direction and on the shaft rotating in the counterclockwise direction an angle of 90° or 270° is adjusted.

The above mentioned parallelism between the blades of a pair secured to the two different shafts when the blades point radially inwardly is repeated along the blades in a sequence of four pitch spacings each. If the shafts now rotate by another 180°, the blades again take up the just mentioned horizontal position but now the blade axes point radially outwardly in a horizontal plane extending through both rotational axes of the shafts. The just described positioning of the blades in parallel planes when the blades face each other in the space centrally between the two shafts and when the blades point radially outwardly without facing each other, is repeated for each full turn of the shafts.

The just described type of rotation of the blades and their sequential positioning for each revolution of each shaft imparts substantial shearing forces to the material being mixed because between the two shafts the material is being piled up as the blades move down and inwardly into the zone between the two shafts and because the blades move upwardly through this zone between the two shafts. Thus, the mixing intensity is substantially improved in an apparatus according to the invention as compared to an apparatus of the type described above with reference to the prior art in which the blades are arranged so that the blades on one shaft reach into the spaces between the blades on the other shaft and vice versa.

The shearing forces are accomplished according to the invention because two blades forming a pair but attached to separate shafts approach each other from opposite directions then pass each other in parallel and then separate again moving away from each other in opposite directions. This is not accomplished in the prior art mixer.

Another important advantage of the invention is seen in that the above mentioned weight reduction amounts to 75% as compared to a prior art structure of this type. The resulting power requirement for driving the mixer is respectively reduced. Accordingly, if the same power is applied, a larger proportion is available for the mixing proper rather than for merely moving the weight of the mixing components. Accordingly, mixers of the invention have a substantially improved mixing capacity and an improved mixing intensity.

By arranging the blades on one shaft with a given angle of attack and by arranging the blades on the other shaft with a different angle of attack, a further intensification of the mixing process is accomplished due to the resulting different flow speeds of the materials being mixed as they move along the shaft from the inlet end toward the outlet end of the mixer.

By making the mixer tiltable relative to the horizontal, the degree of filling may be varied and the residence time influenced.

BRIEF FIGURE DESCRIPTION

In order that the invention may be clearly understood, it will now be described, by way of example, with reference to the accompanying drawings, wherein:

FIG. 2 is a top plan view onto the continuous, throughflow type of mixer wherein the connecting means to the supply vehicle have been omitted for simplicity's sake and wherein the uniform spacing of the mixing blades according to the invention is shown, whereby the uniform spacings between blades are uniformly distributed along both mixing shafts;

FIG. 3 shows a sectional view through the mixer according to the invention along section line 3—3 in FIG. 2, whereby especially the overlap of a pair of blades is shown as the blade axes extend horizontally and radially inwardly relative to the mixing shafts but in opposite directions;

FIG. 4 is a partial view of the means for securing a mixing blade to the respective mixing shaft; and FIG. 5 is a view partially in section along section line 5—5 in FIG. 2 to show the parallel arrangement of a pair of blades both of which point into the zone between the two mixing shafts.

Figure 1:
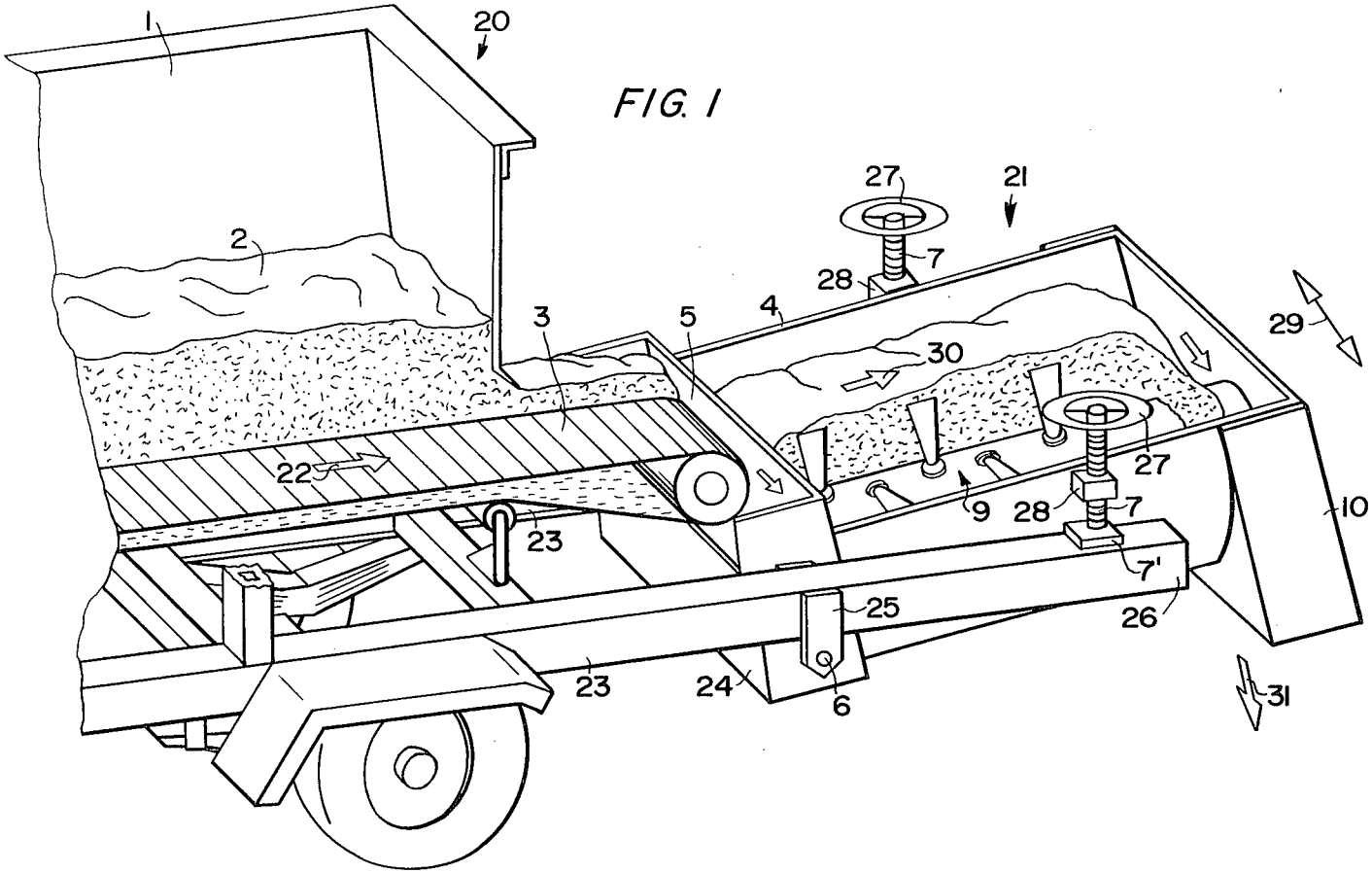
FIG. 1 is a perspective illustration, partially in section, of an apparatus according to the invention for preparing bituminous sludge type mixtures whereby the apparatus comprises a mobile, multiple chamber container, for example, in the form of a vehicle and a continuously operating mixer.

DETAILED DESCRIPTION OF PREFERRED EXAMPLE EMBODIMENTS AND OF THE BEST MODE OF THE INVENTION

FIG. 1 shows the rear end of a supply container 20 comprising multiple chambers 1, for holding the material 2 to be mixed. Only one chamber 1 is shown. However, a plurality of bins may be formed in the vehicle 20 to hold aggregate 2 of various sizes, for example. The supply container 20 is also equipped with storage means for the bituminous binder component. The aggregate 2 and the binder component (not shown) are both supplied into the inlet end 5 of a mixer 21 by means of a conveyor belt 3 or the like travelling in the direction of the arrow 22.

The present mixer may also be used for concrete mixes, whereby the supply container 20 would be equipped with water tanks or the like. The bituminous binder component would normally be used in an emulsified liquid form also held in respective tanks not shown.

Two parallel bars 23 extend rearwardly from the supply container vehicle 20 for holding the housing 4 of the mixer 21 in a trailer type fashion. A journal axis 6 extends operatively through the lower front end 24 of the trailer housing 4 and through brackets 25 secured to the respective parallel bars 23. The parallel bars have rearwardly extending free ends 26 equipped with a socket 7' in which respective spindles 7 are rotatable by means of a hand wheel 27. The spindles 7 extend through spindle nuts 28 rigidly secured to the housing 4 of the mixer 21. By rotating the hand wheel 27, the mixer housing 4 may be adjusted by tilting about the journal axis 6 up and down in the direction of the double arrow 29. This adjustment permits controlling the degree of filling in the mixer and also the residence time of the materials being mixed in the mixer as they travel in the direction of the arrow 30 through the mixer toward the discharge end 10 forming the rear end of the mixer housing 4.

The mixer comprises two mixing tools 9 which mix and convey the components to be mixed toward the discharge end and the completed mixture falls by gravity onto the surface to be constructed, such as a roadway or the like, as indicated by the arrow 31.

FIG. 2 shows a top plan view of the mixer 21 perspectively illustrated in FIG. 1. Two mixing tools 9 are operatively supported in the trough type mixer housing 4, the bottom of which forms two partial trough sections 32 and 33 as best seen in FIG. 3.

Each mixing tool 9 comprises a shaft 8. Each shaft 8 is supported for rotation in conventional bearings 34 held in the end walls 35 of the mixer housing 4. A motor, for example, a hydraulic motor 12 drives the shafts 8 through gear means 13 in a known manner.

Each shaft 8 has secured thereto a plurality of blades 14. These blades 14 are arranged in helical succession with a 90° circumferential staggering around each shaft. However, simultaneously the blades are arranged so as to form four in line rows 36, 37, 38, and 39 of the blades on each shaft 8 as best seen in FIG. 3. A uniform spacing 11 is provided between adjacent blades and this spacing is the same between adjacent blades on each shaft. In this context, adjacent blades are considered blades pointing with their radial axis in opposite directions whereby these "adjacent" blades are located on opposite sides of the respective shafts. Pairs of blades located with their radially extending axes in the same plane enclose an angle of 90° or 270° between these radially extending axes. Hence, for example, the blade 40 and the blade 41 form such a pair because their radially extending axes are located in the same plane 42 which extends perpendicularly to the longitudinal rotational axes 43 and 44 of the respective shaft 8. Similarly, the blades 45 and 46 form such a pair which includes with the respective radially extending axes a right angle in the plane 47.

The plane 48 of each blade extends at an adjustable angle of attack 49 relative to a plane 50 which in turn extends at a right angle to both longitudinal axes 43 and 44.

FIG. 4 shows how the angle of attack 49 may be adjusted. This is accomplished by providing each blade 14 with a foot 51 fitting into a socket 15 in which the foot may be fixed in any desired position by means of a set screw 52. The socket 15 is connected to the perspective shafts 8 in any conventional manner, for example, by welding. By adjusting the angle of attack 49 it is, for example, possible to adjust the blades located near the entrance end of the mixer 21 so as to partially return the material being conveyed into the mixer to the entrance end, whereby such returned proportions of material are again brought into intimate contact with freshly supplied materials moving into the mixer.

Incidentally, the shafts 8 are rotated in opposite directions as indicated by the arrows 53 and 54 in FIG. 3.

The adjustment of the angle of attack 49 has the further advantage that the residence time of the material may be influenced by the angle of attack and that the angle of attack may be adapted to the type of material being conveyed and simultaneously mixed.

FIG. 5 illustrates the parallel position of a pair of blades 40, 46 also shown in FIG. 2. Such a pair of blades is referred to herein as a "meshing pair" of blades and includes one from each shaft. The blades of a meshing pair lie in next adjacent imaginary planes coinciding with radial axes of the mounted blades along both shafts. In such a meshing pair the blades overlap substantially in parallel over most of their area in the space between the shafts as shown in FIGS. 2 and 5. This parallel position takes place when the radially extending axes 55 and 56 of the blades 46 and 40 extend in parallel to each other, whereby these axes face in opposite directions as best seen in FIG. 2. As the blades move inwardly and upwardly, the material being mixed is piled up in a central zone of the mixing housing whereby the material is subjected to intensive shearing action between the blade pairs. Incidentally, the blade edges facing the viewer in FIG. 2 are shown by double lines as opposed to the edge facing away from the viewer.

Although the invention has been described with reference to specific example embodiments, it will be appreciated, that it is intended to cover all modifications and equivalents within the scope of the appended claims.

What is claimed is:

1. An apparatus for mixing construction materials and for placing the resulting mixture on a surface, comprising mixing trough means having an inlet for the construction material and a discharge end for the mixture, supply means arranged for supplying said construction materials into the inlet of said mixing trough means, first and second mixing tools supported for rotation about first and second side-by-side parallel longitudinal rotational axes in said mixing trough means for mixing and simultaneously transporting the materials from said inlet to said discharge ends, each mixing tool comprising a shaft mounted along one of said longitudinal, rotational axes and a plurality of mixing blades operatively secured to each shaft in helical succession with a 90° circumferential staggering from blade to blade on the same shaft, whereby the blades form four in line rows of blades on each shaft, each blade having an axis extending radially relative to the respective longitudinal, rotational shaft axis, said blades being mounted with a uniform axial spacing between adjacent blades along both shafts, all the blades on both shafts further having the same configuration, said shafts being aligned with the uniform axial spacing between adjacent blades coinciding whereby the blade radial axes lie in equally spaced radial planes along the longitudinal rotational shaft axes perpendicular to said longitudinal axis, each blade being mounted on its shaft at a blade angle of attack relative to the respective radial plane, said two shafts being adjusted in their rotational angular position relative to each other so that any two blades on different shafts enclose a right angle between their respective radial axes at each quarter turn of the shafts when these radial axes are located in a common radial plane and so that said first and second shafts comprise a plurality of meshing blade pairs, each meshing pair comprising one blade from each shaft axially spaced from each other in next adjacent radial planes along said longitudinal rotational axes, said shafts being constructed and arranged for rotation in opposite directions with the blades moving upward from the center line between said axes and with the blades of each meshing pair overlapping the major portion of the area of said blades in the space between the shafts, the blades of each meshing pair being substantially parallel when the radial axes of said meshing blades are pointing toward and away from each other, thereby imparting a mixing shearing action to construction material in said trough means and moving said material upwardly along the zone between the mixing tool shafts and then laterally toward the walls of the trough.

2. The apparatus of claim 1, wherein the blade angle of attack of the blades on one shaft differs from the blade angle of attack of the blades on the other shaft.

3. The apparatus of claim 1, further comprising means for adjusting the blade angle of attack for each blade individually by rotating the respective blade about its radially extending axis.

4. The apparatus of claim 3, wherein said adjusting means comprise a socket secured to the shaft, a set screw in said socket, a foot fitting into said socket and secured to the radially inner end of the respective blade.

5. The apparatus of claim 1, wherein said supply means comprise a vehicle, and wherein said mixing trough means comprise a trailer type extension of said vehicle, said vehicle comprising conveyor means for moving said materials from said vehicle proper into said trailer type extension, said apparatus further comprising means operatively connecting said trailer type extension to said vehicle.

6. The apparatus of claim 5, wherein said connecting means comprise two parallel support bars rigidly extending rearwardly from said vehicle, journal means operatively connecting said mixing trough means to said parallel support bars, and position adjustment means operatively interposed between said parallel support bars and said mixing trough means for adjusting the angular position of said longitudinal, rotational axis relative to the horizontal.

7. The apparatus of claim 6, wherein said position adjustment means comprise spindle nut means secured to said mixing trough means, and threaded spindle means operatively connected to said parallel support bars and extending through said spindle nut means for said angular position adjusting by tilting the entire trailer type extension about an axis defined by said journal means.

* * * * *